United States Patent [19]

Keller

[11] Patent Number: 4,781,326

[45] Date of Patent: Nov. 1, 1988

[54] WARM FOG DISSIPATION USING LARGE VOLUME WATER SPRAYS

[75] Inventor: Vernon W. Keller, Huntsville, Ala.

[73] Assignee: The United States of America as represented by the Administrator of the National Aeronautics and Space Administration, Washington, D.C.

[21] Appl. No.: 633,180

[22] Filed: Jul. 23, 1984

[51] Int. Cl.[4] ..... E01H 13/00

[52] U.S. Cl. ..... 239/2.1; 239/14.1

[58] Field of Search ..... 239/2 R, 14

[56] References Cited

U.S. PATENT DOCUMENTS 2,052,626 9/1936 Houghton ..... 239/2 R

FOREIGN PATENT DOCUMENTS 1163339 4/1958 France ..... 239/2 R

OTHER PUBLICATIONS

Junge, C. E., *Methods of Artificial Fog Dispersal and their Evaluation,* Air Force Cambridge Research Center, Sep. 1958, pp. 11, 18.

Houghton, H. G. et al., *On the Local Dissipation of Natural Fog,* M.I.T. & Woods Hole Institute, Oct. 1938, pp. 11, 15-16, 18, 27-38, 40.

*Primary Examiner*—Andres Kashnikow

*Attorney, Agent, or Firm*—Leon D. Wofford, Jr.; John R. Manning; William J. Sheehan

[57] ABSTRACT

To accomplish the removal of warm fog about an area such as an airport runway (11) shown in FIG. 1, a plurality of nozzles (17) along a line (15) adjacent the area propelled water jets (19) through the fog to heights of approximately twenty-five meters. Each water jet (19) breaks up forming a water drop size distribution that falls through the fog overtaking, colliding, and coalescing with individual fog droplets and thereby removes the fog. A water retrieval system (15) is used to collect the water and return it to reservoirs (21) for pumping it to the nozzles (17) once again.

8 Claims, 4 Drawing Sheets

FIG. 2

COLLECTION EFFICIENCY AND TERMINAL VELOCITY OF COLLECTOR DROPS

| COLLECTOR DROP | | COLLECTION EFFICIENCY (FRACTION) | | | | | | | |
|---|---|---|---|---|---|---|---|---|---|
| TERMINAL VELOCITY | RADIUS | FOG DROPLET RADIUS (μm) | | | | | | | |
| (m/sec) | (μm) | 2 | 2.5 | 4 | 5 | 8 | 10 | 15 | 20 |
| .26 | 50 | .01 | .01 | .03 | .20 | .38 | .53 | .61 | .59 |
| .71 | 100 | .01 | .04 | .32 | .48 | .65 | .70 | .69 | .65 |
| 1.2 | 150 | .01 | .14 | .41 | .55 | .68 | .70 | .66 | .61 |
| 1.6 | 200 | .04 | .18 | .45 | .57 | .68 | .69 | .63 | .57 |
| 2.0 | 250 | .06 | .21 | .46 | .58 | .67 | .67 | .60 | .54 |
| 2.5 | 300 | .08 | .23 | .47 | .58 | .66 | .66 | .58 | .51 |
| 3.3 | 400 | .10 | .24 | .47 | .58 | .64 | .63 | .54 | .48 |
| 4.0 | 500 | .12 | .24 | .47 | .58 | .62 | .61 | .51 | .48 |
| 6.5 | 1000 | .15 | .25 | .47 | .55 | .62 | .61 | .51 | .48 |
| 8.8 | 2000 | .08 | .17 | .39 | .47 | .59 | .58 | .51 | .47 |
| 9.2 | 3000 | .03 | .10 | .29 | .38 | .53 | .55 | .49 | .47 |

FIG. 3

GRAVITY SPRAY VOLUME FOR 90 PERCENT REMOVAL OF FOG DROPLETS

| COLLECTOR DROP | | GAL OF SPRAY PER 100 $m^2$ (STATIONARY CLOUD) OR GAL PER MIN PER METER LENGTH OF RUNWAY PER 100m/min AIR SPEED (MOVING CLOUD) | | | | | | | |
|---|---|---|---|---|---|---|---|---|---|
| TERMINAL VELOCITY | RADIUS | FOG DROPLET RADIUS ( μ m) | | | | | | | |
| (m/sec) | (μ m) | 2 | 2.5 | 4 | 5 | 8 | 10 | 15 | 20 |
| .26 | 50 | 406 | 406 | 135 | 20 | 11 | 8 | 7 | 7 |
| .71 | 100 | 812 | 203 | 25 | 17 | 12 | 12 | 12 | 12 |
| 1.2 | 150 | 1218 | 87 | 30 | 22 | 18 | 17 | 18 | 20 |
| 1.6 | 200 | 406 | 90 | 36 | 28 | 24 | 24 | 26 | 28 |
| 2.0 | 250 | 338 | 97 | 44 | 35 | 30 | 30 | 34 | 38 |
| 2.5 | 300 | 304 | 106 | 52 | 42 | 37 | 37 | 42 | 48 |
| 3.3 | 400 | 325 | 135 | 69 | 56 | 51 | 52 | 50 | 68 |
| 4.0 | 500 | 338 | 169 | 86 | 70 | 65 | 67 | 80 | 85 |
| 6.5 | 1000 | 541 | 325 | 173 | 148 | 131 | 133 | 159 | 169 |
| 8.8 | 2000 | 2030 | 955 | 416 | 345 | 275 | 280 | 318 | 345 |
| 9.2 | 3000 | 8119 | 2436 | 840 | 641 | 460 | 443 | 497 | 518 |

WARM FOG DISSIPATION USING LARGE VOLUME WATER SPRAYS

ORIGIN OF THE INVENTION

The invention described herein was made by an employee of the United States Government and may be manufactured and used by or for the Government of the United States for governmental purposes without the payment of any royalties thereon or therefor.

TECHNICAL FIELD

This invention relates to warm fog dissipation by using large volume water sprays, and to water spray systems for spraying large quantities of water in a specific area to eliminate warm fogs.

BACKGROUND ART

Warm fog has frequently been the cause of aircraft takeoff and landing delays and flight cancellations. Much research has been conducted to obtain further knowledge on the physical and electrical characteristics of warm fog with the hope that a sound understanding would suggest a practical way to modify warm fog for improved visibility and subsequently increase airport utilization.

Promising methods and techniques developed included the seeding with hygroscopic material such as salt particles, using charged particle generators which produce a high-velocity jet of air and charged water droplets which disperse fog by modifying its electric field structure, using heaters and burners that evaporate the fog-forming droplets, using helicopters for mixing dry air downward into the fog, and dropping water from an aircraft in order to dissipate the fog.

These prior techniques have a characteristic of being expensive or being ineffective on a large scale or producing considerable environmental pollution.

Accordingly, it is an object of this invention to provide an effective technique for fog dissipation on a large scale.

Another object is to provide a system for spraying large amounts of water in the air adjacent airport runways for fog dissipation.

BRIEF DISCLOSURE OF INVENTION

The present invention accomplishes the dissipation of warm fog by propelling large quantities of water vertically to heights of approximately twenty-five meters by a plurality of spaced nozzles arranged in a row or rows adjacent the area to be cleared of fog such as an airport runway. Each vertically propelled water stream breaks up forming a drop size distribution which falls to the ground due to gravity. As the waterdrops fall through the fog they overtake, collide and coalesce with individual fog droplets, and then precipitate to the ground; thereby each drop removes several fog droplets. Thus, the fog in the area or the vicinity of the water jets is dissipated, including the area somewhat downwind of the water sprays. In the example of an airport runway, a water retrieval system may be used to collect the water upon its return to ground and place it into reservoirs for pumping into the air once again.

BRIEF DESCRIPTION OF THE DRAWINGS

FIG. 2 is a table showing the collection efficiency and terminal velocity of collector drops from the water spray.

FIG. 3 is a table showing the spray volume from the water jet nozzles for 90 percent removal of fog droplets.

BEST MODE FOR CARRYING OUT THE INVENTION

Figure 1:
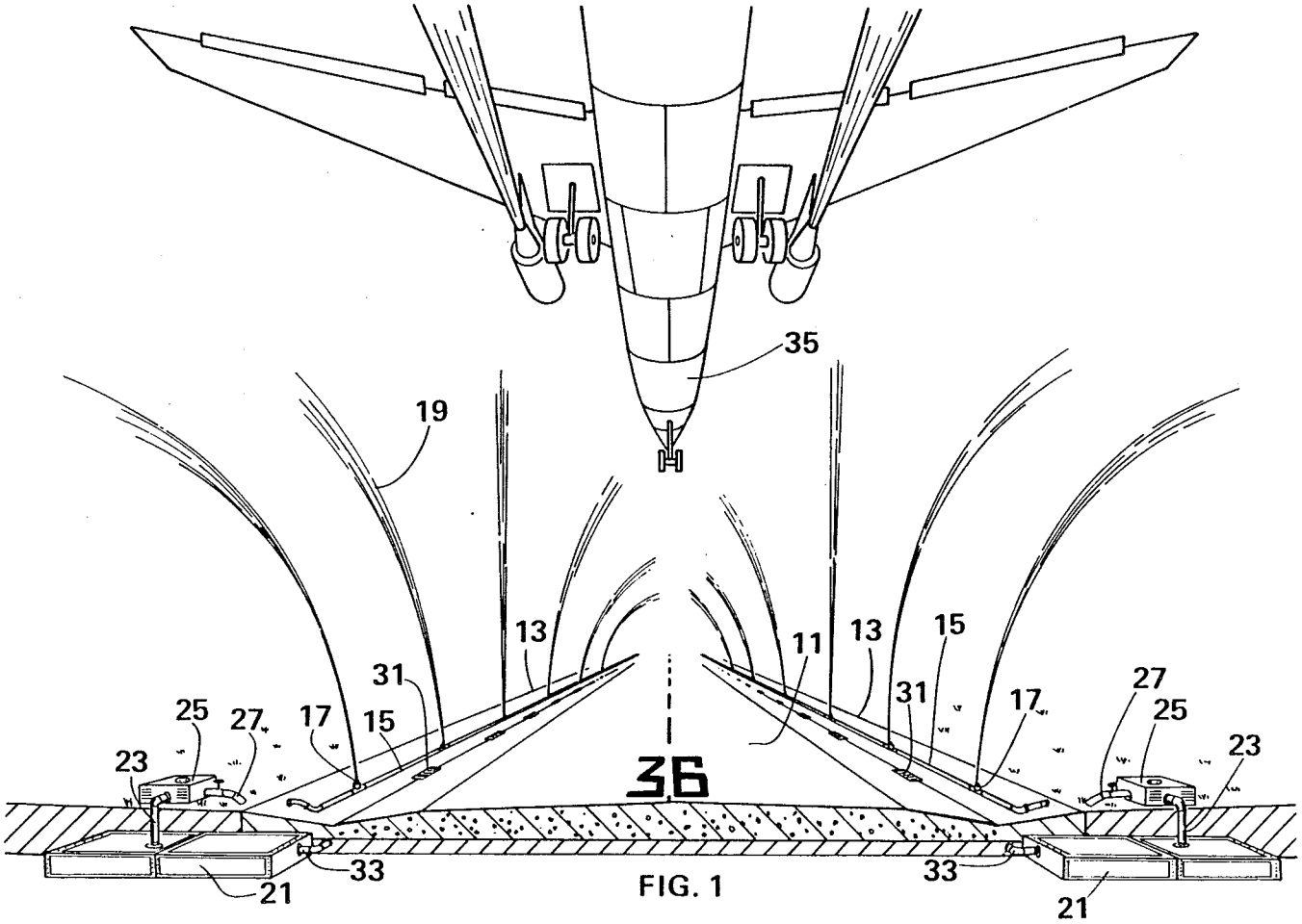
FIG. 1 is a perspective view of an airport runway showing the water jet apparatus according to the present invention installed along the sides of the runway, portion in section to reveal the underground water reservoirs.

Referring to FIG. 1 wherein is shown an airport runway 11 with a shallow depression 13 along each side for collecting water. Also, along each side of the runway 11 within the shallow depression 13 and on the back bank is a pipe line 15 having spaced nozzles 17 for spraying water 19 upwardly. Water is pumped from an underground reservoir 21 on each side of the runway 11 by utilizing an inlet line 23 that leads into a pump (not shown) in a housing 25 and an outlet line 27 from the pump that is connected to the pipe line 15. A pump having sufficient flow and head pressure for this purpose was developed by the National Aeronautics and Space Administration for fighting fires (see NASA TM 82444, dated October 1981, available from the National Technical Information Service, Springfield, Va. 22151). A filter (not shown) may be associated with the inlet line 23 to filter the water being pumped.

The nozzles 17 are spaced approximately 30 meters apart along the line 15 to provide a flow through each nozzle 17 of approximately 1500 gallons per minute (gpm), or a total of about 100,000 gpm adjacent the runway 11 to be cleared of warm fog. The nozzles 17 are sized to project the water vertically to heights of approximately twenty-five meters and, preferably, such that the spray patterns overlap. This may be accomplished by using two inch diameter tapered bore nozzles and operating pressures between 150 and 200 pounds per square inch (psi). The water falling back about the runway 11 is collected in the shallow elongated depressions or ditches 13 and allowed to drain through suitable open drains 31 into a collector pipe 33 within the ground adjacent each side of the runway 11, which pipe 33 leads to the underground reservoir 21 adjacent to each runway side.

To ensure that additional fog is not created through evaporation/condensation processes it is important that the temperature of the water jets be as near to the ambient air temperature as possible. Under some atmospheric conditions the temperature of the reservoir water before activation of the pumping modules may be substantially different from that of the ambient air. The water temperature may change somewhat due to compressional heating or expansive cooling as it passes through the large volume flow nozzles 17 and is propelled vertically to heights exceeding twenty-five meters. However, the largest changes in water temperature will occur as the water in the form of drops falls through the ambient air which is at temperature, Ta, impacts the ground which is at temperature Tg, recombines to form a runoff that flows across the ground surface and into the underground reservoirs. Since the thermal relaxation time constant for a 1 mm diameter water drop having an initial temperature of +25° celsius (C) and falling at a terminal speed of 4 meters per second (m $s^{-1}$) through air as cold as +15° C. is less than 1 second, drops projected as high as twenty-five meters have more than ample time to approach the temperature of the ambient air provided they are sufficiently dispersed, e.g., the heat capacity of air is approximately $2.4\times10^{-4}$ that of water. By recycling the runoff water the soil temperature in the runoff area and then the reservoir water itself will approach the ambient air temperature with a time constant which is site specific depending upon the initial temperature difference between the reservoir water and the ambient air, the volume of water in the reservoir, the pumping rate, the area and rate of drainage, the soil conditions such as porosity and thermal conductivity, the wind speed, the radiational cooling rate, the area of reservoir wall in contact with the water and the thermal conductivity of the reservoir wall.

The reservoirs 21 must have sufficient capacity to supply the nozzles 17 for the several minutes it takes the water to be sprayed aloft, precipitate, and return to the reservoirs. The reservoir volume should be minimized, however, to decrease the recycling time constant. Since the ambient air must be close to water saturation for fog to occur, evaporation losses will be minimal. However, since some runoff losses will occur and since insufficient fog water will be removed to balance the runoff losses, it will be necessary to periodically replenish the reservoirs 21 through capture of rainwater or addition of water from some other source.

The nozzles 17 on the water line 15 may include features (not shown) to apply a rotary and/or vibratory motion to the nozzles so as to cause a sweep of a larger air volume. In this manner a more active control of the resultant water jet breakup at its maximum height is possible to achieve the desired collector drop size distribution. In FIG. 1, the water jets 19 are shown with a rotary motion and being directed away from an approaching aircraft 35.

Under still conditions the water jets 19 from the nozzles 17 of a pipe line 15 can be projected directly over the runway 11 from either or both sides. However, since fog is nearly always accompanied by a light wind of one meter per second (1 m $s^{-1}$) or greater, a better arrangement of the nozzles 17 will place the water jets 19 parallel to the runway 11 with the active nozzles on the upwind side of the runway area to be cleared. In this configuration, the fog is effectively processed through a curtain of water sray created by the water jets 19.

In operation, the water jet 19 is projected at a high velocity of 50 m $s^{-1}$ from the nozzle 17, and it is decelerated by gravity and air resistance and breaks up at a rate depending on its size and turbulence characteristics. After reaching a vertical height of twenty-five meters or more the drops formed by the water jet break up and fall to the ground due to gravity. The optimum size for the falling collector drops is between 300 microns ($\mu$m) and 1000 microns ($\mu$m) in diameter. As these falling collector drops move through a fog they will overtake and collide with individual fog drops which typically have diameters of order 10 $\mu$m and typically fall one or two orders of magnitude slower than the collector drops.

A stationary fog presents the simplest case for calculating the fraction of fog drops removed by the present invention. In this case a monodisperse water spray is considered uniformly distributed over a horizontal area, A, and falling under the influence of gravity. The number, N, of drops with a radius, R, sweep out the fog droplets in an effective cross-sectional area of $N\pi R^2E$ where E is the collection efficiency of the collector drops for fog drops. If $\Delta V$ is the volume of water dispersed into drops of radius R then $N=\Delta V/(4\pi R^3/3)$. The fraction of fog drops removed is given by $$\Delta n/n=N\pi R^2E/A=3E\,\alpha V/4RA \quad (1).$$

This fraction is independent of the fog drop concentration, n. Continued spraying of water will result in a logarithmic diminution in concentration, i.e., $$n=n_o\exp(-3EV/4RA) \quad (2)$$

where $n_o$ and n are the initial and final fog drop concentrations respectively and V is the total volume of water sprayed. Thus, in the case of a stationary fog the total water spray volume, not the spray rate, is important.

A moving fog presents a more pertinent case. If a fog moves at uniform velocity, U, through a water spray curtain uniformly distributed along a length, L, and having a total water flow rate per unit time, Q, then in time, T, a volume QT of water will be delivered on an area, LUT, of the fog. Therefore $$n=n_o\exp(-3EQ/4RLU) \quad (3).$$

For the moving fog the thickness of the curtain along the direction of motion of the wind is unimportant. The volume rate of spraying per unit length of curtain is important. The total volume of air processed through the curtain of water spray is given as a function of time by the product of the curtain height, the curtain length, and the wind velocity component normal to the curtain.

The only fog drop removal process which has been considered in these simple calculations is removal by the water spray as it falls due to gravity. Supplementing this process but more difficult to quantity is fog drop removal by entrainment in the vertically directed water jets and removal by the high velocity projected drops as they decelerate.

Drops projected at high velocity have larger collection efficiencies than drops falling at terminal speed under gravity. The difference in efficiencies is greatest for small collector drops, especially when collecting the smallest fog droplets, and increases with increasing projection velocity. The distance a drop travels during the deceleration phase is a moderate function of its initial velocity and a strong function of its size. Even drops as large as 250 $\mu$m radius only travel about 3 meters when projected with an initial velocity of 30 m $s^{-1}$. Since this distance is small compared to the gravity fall distance, the primary contribution of this process is in removal of some of the very smallest fog droplets.

Solving equation (3) for Q, the water flow rate per unit time, gives $$Q=(-4RLU/3E)\ln(n/n_o) \quad (4).$$

If ninety percent of the fog drops are removed then $n/n_o=0.1$ and $\ln(n/n_o)=-2.30$. If only seventy percent of the fog drops are removed then $\ln(n/n_o)=-1.20$. Letting L=1 meter; U=100 m $min^{-1}=1.7$ m $s^{-1}$ and assuming ninety percent removal of the fog drops this equation (4) reduces to $$Q=0.0812\,R/E\ (\text{Gpm}) \quad (5)$$

Where R is the collector drop radius in $\mu$m, E is the collection efficiency (fraction) of this collector drop for a fog drop having radius r (μm) and Q is the water flow rate required in gallons per minute for each meter length of spray curtain.

Available values for the collection efficiency of collector drops for fog size drops were derived by K.V. Beard and H. T. Ochs and are shown in FIG. 2. Using the information of FIG. 2 with equation (4) for Q, the volume of curtain water spray required for ninety percent removal of fog drops per meter length of runway for a fixed cross-wind component of 1.7 m $s^{-1}$ has been computed for various monodisperse water sprays and monodisperse fog drops and is given in FIG. 3. For only seventy percent removal of fog drops, values in FIG. 3 should be halved. The FIG. 3 equivalently gives the volume of spray water required for ninety percent removal of fog drops in a stationary cloud which covers a horizontal area of 100 square meters.

In determining the optimum spray size spectra, one should minimize the amount of spray water required while maximizing the visual range. From FIG. 3 alone, it would appear that 50 μm or 100 μm radius collector drops might be optimum for all but the very smallest fog drops. However, other considerations must be taken into account. Most importantly, the water spray must not be carried by fluctuating winds into the cleared volume thus reducing the visual range. In this regard it is important to note that for a given wind speed the larger drops will drift only about one-tenth the distance that the smaller ones will, i.e., 300 μm radius drops fall with a terminal velocity of 2.5 m $s^{-1}$ whereas 50 μm radius drops fall at only 0.26 m $s^{-1}$ (see FIGS. 2 or 3). Secondary considerations include the facts that it is easier to propel larger drops to greater heights and that the time between system startup and commencement of fog clearing is slightly shorter for larger drops. Combination of these trade-offs sets the optimum water spray mass mean drop radius between 150 μm and 500 μm depending on wind conditions.

It can be seen from FIG. 3 that for even 500 μm radius collector drops and fog drops as small as 4 μm radius, less than 100 gpm of water spray is required per meter length of runway to remove 90 percent of the fog droplets from a cloud moving with a cross-wind component of 1.7 m $s^{-1}$. Since fog drop mean radii are typically 5 μm to 10 μm and since the visual range is inversely proportional to the concentration of fog drops, less than 100,000 GPM of water spray is required under the stated conditions to clear a 1 km length of runway. Water vapor will not be added to the system provided that the temperature of the water spray and the ambient air are equal since the air is already saturated, e.g., a fog exists.

Figure 4:
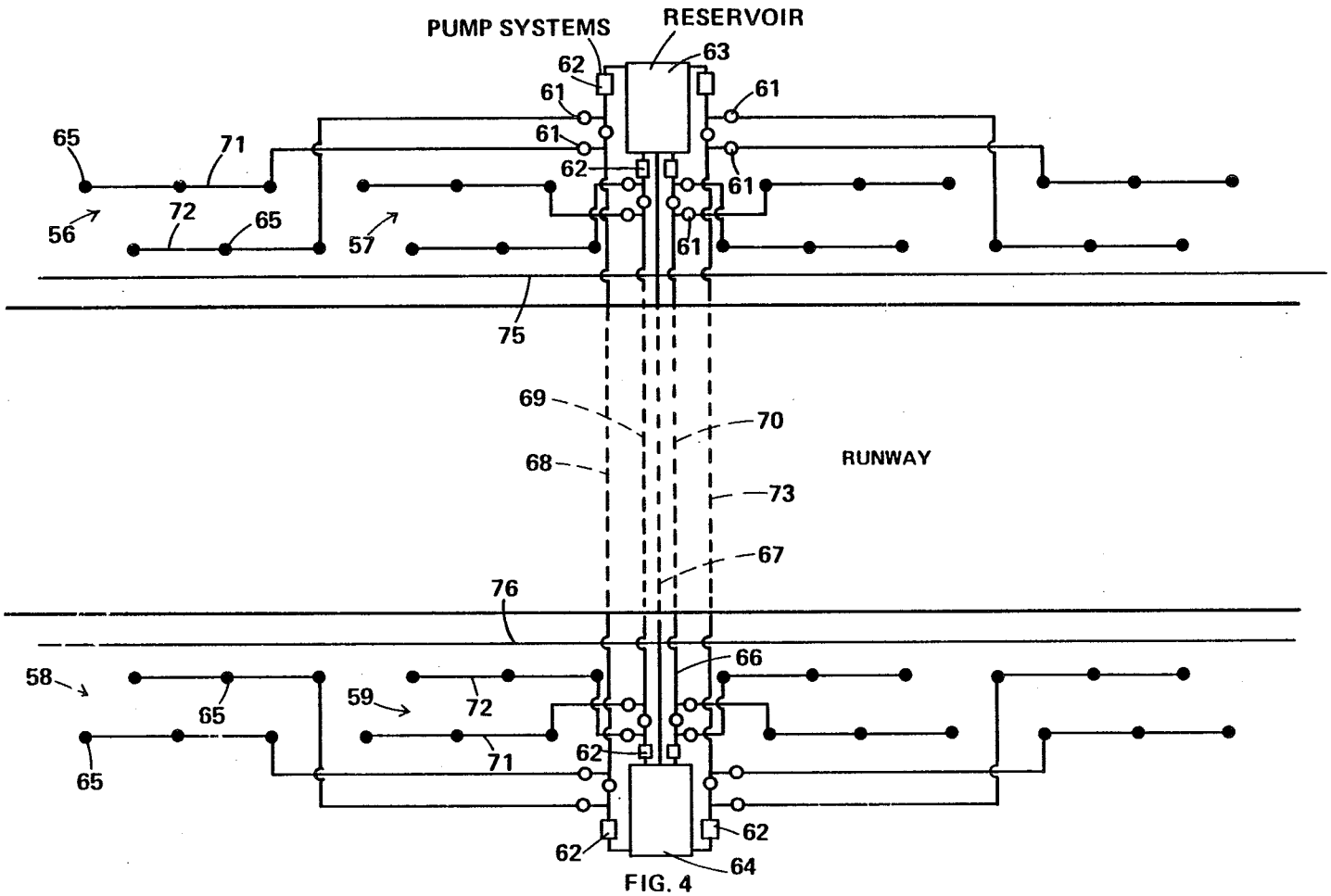
FIG. 4 is a plan view of another arrangement of a water jet apparatus along an airport runway.

FIG. 4 shows a plan view of an aircraft runway having a different arrangement for the water nozzle lines, reservoir, and pumps than that shown in FIG. 1. On each side of the runway 60 are spaced groups 56, 57, 58, 59 of parallel rows 71, 72 of water lines, each line having a valve 61 for controlling the water flow therein. Each group 56, 57, 58, 59 of water lines 71, 72 has a pump system 62 for pumping water from one of the two reservoirs 63, 64.

Each water line has spaced nozzles 65 for projecting the water upwardly. A pair of drain lines 75, 76, one on each side of the runway 60, that are placed in a ditch similarly to that shown in FIG. 1 collect the falling water and have it drain into the reservoirs 63, 64 through an interconnecting main collector line 67.

Groups of parallel rows of water lines are interconnected by connection lines 68, 69, 70, 73 so that a pump with proper operation of valves 61 may pump water to either side of the runway 60. Thus, it is readily apparent from FIG. 4 that the valves 61 may be opened and closed to permit spraying water on either or both sides of the runway 60 whichever is most advantageous. A suitable pump system will be capable of pumping 5,000 gpm, and each reservoir 63, 64 will have a capacity of 200,000 gallons. Similarly to the configuration of FIG. 1, the nozzles 65 are spaced apart approximately 30 meters and have a flow each of approximately 1500 gallons per minute (gpm) through a two inch diameter tapered bore at an operating pressure of between 150 and 200 pounds per square inch (psi).

While there has been described a best mode of the invention, variations and modifications and other uses, such as the utilization of the invention aboard an aircraft carrier, will readily be apparent to those skilled in the art.

I claim:

1. A warm fog dissipation system using a large volume of water spray comprising:

an area subject to warm fog, means adjacent said area for spraying water in a line of overlapping spray patterns into the air to a height of at least twenty-five meters whereby said water breaks up forming a drop size distribution which falls through a fog, overtaking, colliding, and coalescing with individual fog drops and thereby causes the fog drops to precipitate to the ground, a first water reservoir for supplying large volumes of water to said means for spraying water, a water collection system associated with said area for capturing a significant amount of water sprayed into the air and returning it to said first water reservoir, said means for spraying water into the air having a first pipe line adjacent a side of said area, said first pipe having outlet nozzles along its length for spraying water into the air, a first pump means for pumping water from said first water reservoir into said first pipe line, said spray nozzle and pump means being sized to produce to a maximum extent an approximate mean water drop diameter between 300 and 1000 microns.

2. A system according to claim 1 which includes:

said means for spraying water into the air having a second pipe line adjacent a side of said area opposite the side adjacent said first pipe line;

said second pipe having outlet nozzles along its length for spraying water into the air, a second reservoir for supplying a large volume of water, said water collection system also returning a portion of said captured water to said second reservoir, a second pump means for pumping water from said second reservoir into said second pipe line.

3. A warm fog dissipation system using large volume of water sprays comprising:

a runway adapted to be used by aircraft;

a depression adjacent each side of said runway for collecting water;

a first pipe line along a bank of said depression;

said first pipe line having outlet nozzles along its length for spraying water into the air to a significant height in excess of twenty-five meters;

a first water reservoir for supplying large volumes of water;

a first pump means for pumping water from said first water reservoir into said first pipe line whereby said water is propelled to a height in excess of twenty-five meters and breaks up forming a drop size distribution which falls through a fog, overtaking, colliding, and coalescing with individual fog drops and thereby causes the fog drops to precipitate to the ground;

drainage means for collecting water from said depressions and furnishing it to said reservoir.

4. A system according to claim 3 which includes:

a second pipe line having outlet nozzles along its length;

said second pipe line along a bank of said depression opposite the depression having said first pipe line and adjacent a portion of a side of said runway opposite the side adjacent said first pipe line;

a second water reservoir for supplying large volumes of water;

a second pump means for pumping water from said second reservoir into said second pipe line whereby said water is propelled to a height in excess of twenty-five meters.

5. A method of dissipation of warm fog about an area comprising:

spraying a plurality of water jets from spaced apart nozzles along a line adjacent the area to be cleared of warm fog into said warm fog to a vertical height in excess of twenty-five meters, the spray patterns from the nozzles overlapping, each said water jet, being decelerated by gravity and air resistance so as to break up to a maximum extent into a mean falling collector drop diameter between 300 and 1000 microns, said falling collector drops overtaking and colliding with individual fog drops, each said water jet upon breakup having a temperature closely corresponding to the ambient temperature, said line along which the nozzles are spaced is located on the upwind side of the area to be cleared of fog so as to form a curtain of water spray and falling collector drops.

collecting a substantial portion of said falling collector drops that constitute runoff about said area into a reservoir for pumping water to said spaced nozzles, said spaced nozzles being spaced approximately 30 meters apart and having a flow through each nozzle of approximately 1500 gallons per minute.

6. A warm fog dissipation system using large volume water sprays comprising:

an area subject to a warm fog, a first pipe line section adjacent a portion of one side of said area, a second pipe line section substantially parallel to said first pipe line and adjacent a portion of another side of said area, each said first and second pipe line sections having nozzle means spaced along their length for spraying a water jet to a vertical height of at least twenty-five meters in an overlapping pattern which upon deceleration by gravity and air resistance break up to the maximum extent into falling collector drops having a mean diameter between 300 and 1000 microns, said falling collector drops adapted to collide and coalesce with individual fog droplets, a first water reservoir for suppling large volumes of water adjacent said first pipe line section, a second water reservoir for supplying large volumes of water adjacent said second pipe line section, a drainage pipe system for collecting a substantial portion of said falling collecting drops that constitute runoff about said area and draining said runoff water into said reservoirs, a first pump means for pumping water from said first water reservoir into said first pipe line section, and a second pump means for pumping water from said second water reservoir into said second pipe line section, interconnecting pipe systems between said first and second pipe line sections to enable either of said first and second pump means to pump water to either of said first and second pipe line sections.

7. A system according to claim 6 including:

a third pipe line section adjacent said first pipe line section and on the same side of said area as said first pipe line section, a fourth pipe line section adjacent said second pipe section and on the same side of said area as said first pipe section, said third and fourth pipe line sections having nozzle means spaced along their length for spraying a water jet to a vertical height of about twenty-five meters similarly to that of said nozzle means of said first and second pipe line sections, said first pump means also pumping water into said third pipe line section, and a said second pump means also pumping into said fourth line section.

8. A system according to claim 7 wherein:

said nozzle means on said pipe line sections are spaced approximately thirty meters apart, and have a two inch tapered bore nozzle having an operating pressure between 150 and 200 psi and water flow of approximately 1500 gpm.

* * * * *